United States Patent [19]

Von Allmen et al.

[11] Patent Number: 4,797,166

[45] Date of Patent: Jan. 10, 1989

[54] METHOD FOR PRODUCING AN AT LEAST PARTLY AMORPHOUS ALLOY PIECE

[75] Inventors: Martin Von Allmen, Zollikofen; Andreas Blatter, Ostermundigen, both of Switzerland

[73] Assignee: Cendres & Metaux, S.A., Biel, Switzerland

[21] Appl. No.: 47,481

[22] Filed: May 11, 1987

[30] Foreign Application Priority Data

May 29, 1986 [CH] Switzerland ..... 02177/86

[51] Int. Cl.[4] ..... C21D 1/26

[52] U.S. Cl. ..... 148/13.1; 148/403

[58] Field of Search ..... 148/4, 403, 304, 13; 420/422

[56] References Cited

U.S. PATENT DOCUMENTS 4,226,647 10/1980 Schulson et al. ..... 420/422

4,639,363 1/1987 Komatsu et al. ..... 148/403

*Primary Examiner*—Melvyn J. Andrews

*Assistant Examiner*—S. Kastler

*Attorney, Agent, or Firm*—Brady, O'Boyle & Gates

[57] ABSTRACT

An alloy, e.g. a Cr-Ti alloy, is transformed to a metastable crystal modification, e.g., by heating in an electric arc and quenching in water. The metastable crystal modification is annealed at a temperature which is below the glass temperature, e.g. at 600° C. during 48 hours, causing it to vitrify completely.

The inventive method provided the production of large pieces of hard and non-porous amorphous alloy with thicknesses in the centimeter range.

3 Claims, 2 Drawing Sheets

METHOD FOR PRODUCING AN AT LEAST PARTLY AMORPHOUS ALLOY PIECE

The invention relates to a method for producing an at least partly amorphous alloy piece.

According to the present state of industrial technology, amorphous (noncrystalline, vitrified or glassy) alloys are produced by very rapid cooling of suitable metallic melts. In order to achieve vitrification rather than crystallization during the cooling step, cooling rates as large as 1000° C./millisecond are generally required. Cooling rates of this order of magnitude are commonly achieved by spraying the melt by means of nozzles onto rapidly rotating cooling wheels. This technique is known as melt spinning. The products of this and similar methods of fabricating amorphous alloys are typically shaped as very thin foils or ribbons, having thicknesses of no more than a few tens of micrometers. Because of the fundamental inverse relationship between the thickness and the cooling rate, it is not possible to increase the thickness of the amorphous products significantly in the melt quenching technique.

An alternative method enabling the production of amorphous wires with a thickness in the mm range has been proposed (L. Schutz in "Amorphous Metals and Nonequilibrium Processing", ed. by M. von Allmen, Edition de Physiqe, Les Ulis 1984). It consists in forming a laminate from alternating thin foils of pure crystalline Nickel (Ni) and pure crystalline Zirconium (Zr) which are wound up in the form of a spiral, from which a wire is then drawn. The wire is subsequently annealed at moderate temperature. The cold-drawing and annealing procedures cause the elements Ni and Zr to mix by solid-state diffusion, upon which the alloy also becomes amorphous. This method has the disadvantage of being rather complex and expensive. It is only applicable to mixtures of elements having markedly different diffusion constants as well as strongly negative heats of mixing. Moreover, the resulting amorphous alloys tend, as a direct result of the diffusion process, to be porous and mechanically weak. This also holds, at least in part, for another related process, in which a mixture of elemental crystalline powders is subjected to prolonged milling in a ball mill, upon which also interdiffusion and amorphization by cold-working occurs.

An object of the present invention is to provide a simple and inexpensive procedure that allows the production of large pieces of hard and non-porous amorphous alloy.

The present invention is based on the surprising discovery, found in the scope of the present invention, that suitable alloys can be prepared in the form of metastable crystal modifications and vitrified spontaneously upon mere annealing, without any further processing steps and without long-range diffusion (i.e. diffusion over many atomic diameters) being involved. A metastable crystal modification is defined as a crystal structure which persists indefinitely under the proper conditions, but which does not correspond to thermodynamic equilibrium.

The present method enables the production of pieces of amorphous alloy with thicknesses in the centimeter range, rather than just thin foils. The reason is, that vitrification is not achieved by rapid cooling of a melt (which is only possible for thin layers), but by extended annealing in the solid state. Moreover, since the present method is based upon annealing a homogenous (metastable) crystal modification rather than an inhomogenous laminate, it achieves vitrification without long-range diffusion and therefore yields non-porous amorphous products.

In order to achieve vitrification by mere annealing, the alloy, according to the present invention, must first be prepared with the structure of a metastable crystal modification. The latter can be a solution crystal or a compound crystal which is stable only at high temperature, and which is therefore undercooled at lower temperatures. The preparation of the metastable crystal modification can involve a quenching process, but the cooling rates required are typically many orders of magnitude smaller than those required by the well-known methods of glass formation by melt quenching. The starting product for the present method can be a normal alloy, produced by conventional metallurgical procedures like melting and casting. The alloy can, for example, be a binary one in which the composition is chosen such that there exists a high-temperature solution crystal or a high-temperature compound crystal of this composition and with the special property that, at temperatures below the glass temperature, it has a lower free energy than the glass phase, but that it neverthelss can be prepared and kept at ambient temperature. Binary systems of interest in this connection are systems exhibiting stable high-temperature solution or compound crystals (of which alone there are dozens to hundreds), as well as systems exhibiting solutions or compounds that are metastable at all temperatures but that can be prepared by quenching from the melt. Of special interest for the present method are solution crystals with large lattice strain energies, as formed in combinations of elements with appreciably different atomic radii. Undercooled solution crystals can be prepared in suitable systems by heating the alloy above a characteristic transformation temperature, followed by quenching, e.g., in water. Other possible methods to produce metastable crystal modifications are the application of high pressure or chemical deposition techniques.

Examples of embodiments of the invention will be explained in greater detail hereinafter with reference to the accompanying drawings, in which.

Figure 1:
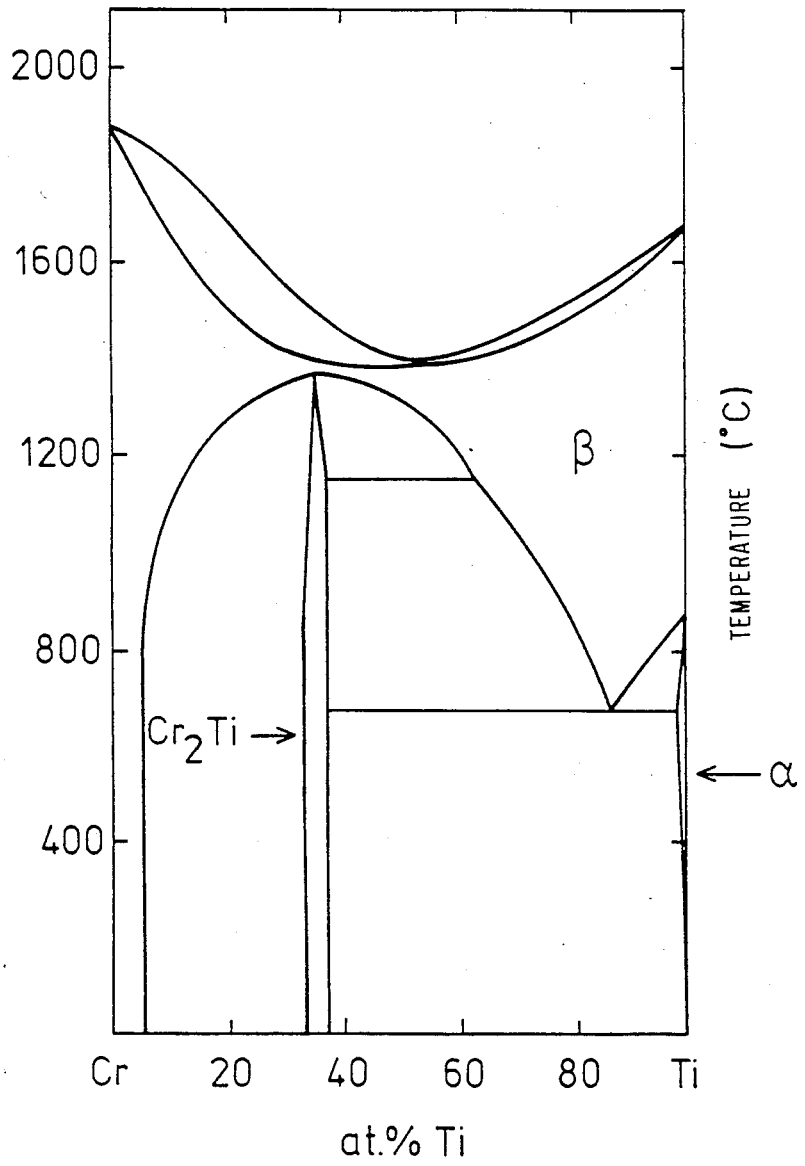
FIG. 1 is the phase diagram of the Cr-Ti (Chromium-Titanium) system, in which $Cr_2Ti$ and Alpha designate two phases that are stable at low temperature, while Beta designates a high-temperature solution crystal which is metastable at lower temperatures.

A procedure to obtain amorphous pieces of Cr-Ti alloy according to the present invention involves three steps. In a first step, chemically pure powders of Cr and Ti are weighted out at an atomic ratio of 40:60 and melted together. The crystal structure of the alloy thus formed corresponds to thermodynamic equilibrium ($Cr_2Ti$ and Alpha, see FIG. 1). Next, pieces several millimeters accross are cut from the alloy, heated under inert gas to 1200° C. for several seconds by means of an electrical arc or a laser beam and subsequently quenched in water. The resulting structure is the high-temperature solution crystal (Beta-$Cr_{40}Ti_{60}$) which is metastable at ambient temperature. The. last step consists in annealing the pieces of metastable alloy at 600°

C. (below the glass temperature of about 650° C.) under vacuum for about 48 hours, during which they vitrify spontaneously and completely. The vitrification manifests itself by changes in several macroscopic properties, such as by increases of the electrical resistance, of the elasticitiy as well as of the hardness (the latter from some 6 to some 10 GPa Meyer-scratching hardness). One of the advantages of the method is that mechanical processing of the pieces needs not be executed in the hard amorphous state, but may already be performed while the alloy is in the softer Beta state.

The metastable crystal modification can also be obtained directly from an alloy melt under observance of appropriate cooling rates. For example a melt of Cr and Ti at an atomic ratio of 40:60 is first cooled slowly at a cooling rate of 10° C./s to 1200° C. and thereafter quenched at a cooling rate of some 100° C./s down to 600° C., whereupon the obtained metastable crystal modification is annealed at the final temperature of the quenching process of 600° C.

In order to combine the qualities of the amorphous and the crystalline states, it is possible to produce pieces consisting partly of amorphous and partly of crystalline material. Pieces with an amorphous surface and a crystalline core can be obtained by only transforming the surface region into the metastable crystalline state, followed by annealing of the whole piece. The procedure is the same as described above, except that quenching of the piece after heating to 1200° C. is done more slowly, possibly without water. This causes only a surface layer of the piece to cool rapidly enough for the Beta modification to persist, while the interior transforms to the equilibrium crystal structure ($Cr_2Ti$+Alpha). Upon subsequent annealing only the surface layer then vitrifies while the interior stays crystalline.

Figure 2:
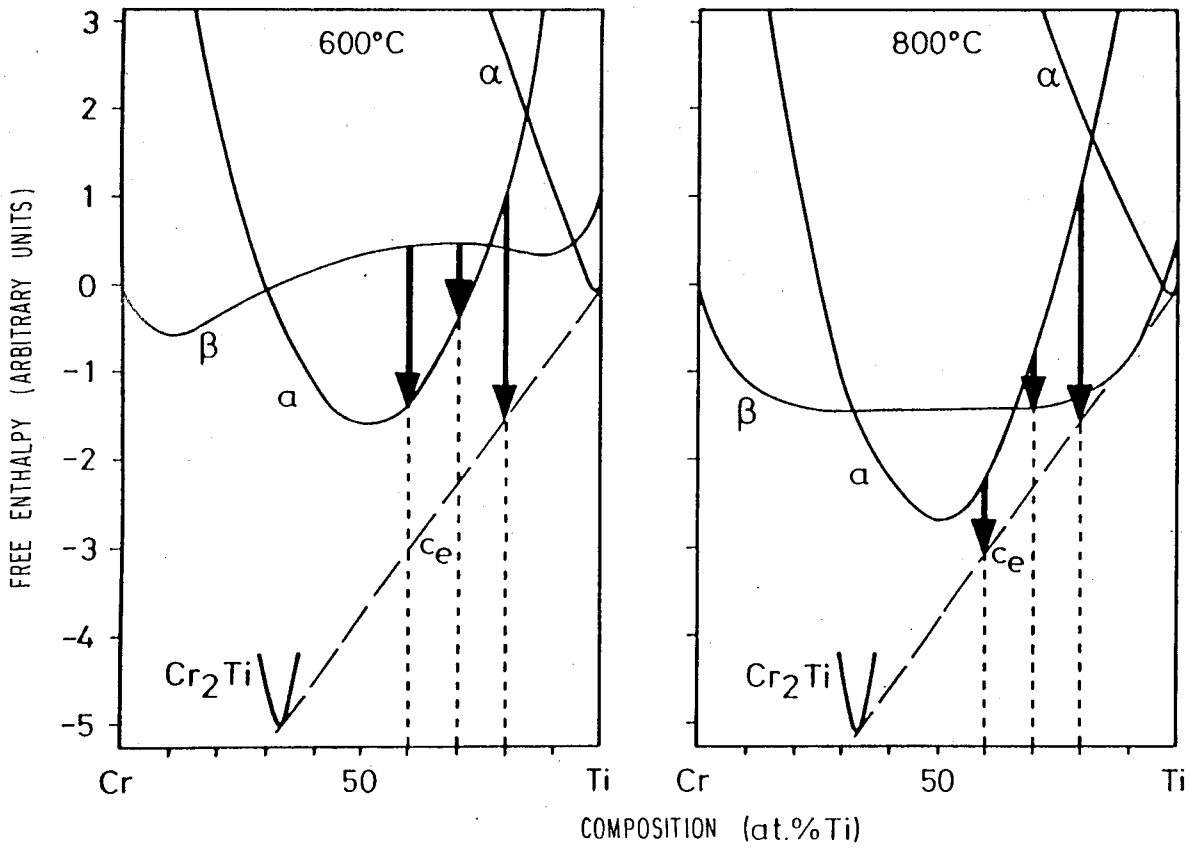
FIG. 2 shows the free enthalpy (also called Gibbs' free energy) as a function of composition in the Cr-Ti system at 600° C. and 800° C. Here "a" designates the amorphous phase, $c_e$ designates the equilibrium configuration, and vertical arrows symbolize possible transformations.

The present method can be applied to the Cr-Ti system also at compositions other than 40:60. One may, for example, select a composition 30:70. At this composition, the vitrification process is slower and requires longer annealing time, but it is reversible in the sense that heating the vitrified alloy to 800° C. (and possibly annealing at this higher temperature) causes the material to transform back to the metastable Beta crystal. For illustration, FIG. 2 shows the free energies of the phases in question, with arrows symbolizing various possible transformations.

The present method can also be applied to alloy systems other than Cr-Ti. These include binary systems as well as ternary or more complex ones. Examples of binary and ternary systems suitable for the present method of amorphization are the systems cobalt-niobium, copper-titanium, iron-titanium, manganese-titanium, niobium-nickel and iron-chromium-titanium. Generally favorable alloys are those containing at least one of the elements Si, Al, Ti, V, Cr, Mn, Fe, Co, Ni, Cu, Zr, Nb, Mo, Pd, Ag, Hf, Ta, W, Pt or Au.

We claim:

1. A method for producing an at least partly amorphous alloy piece, comprising the steps of preparing an alloy composition of at least two elements of appreciably different atomic radius, at least one of said elements being elected from the group consisting of Si, Al, Ti, V, Cr, Mn, Fe, Co, Ni, Cu, Zn, Zr, Nb, Mo, Pd, Ag, Hf, Ta, W, Pt or Au, the composition being chosen such that a high -temperature solution crystal or high-temperature compound crystal exists for said composition, heating the composition to an elevated temperature with respect to the glass temperature, so that the composition becomes a high-temperature solution crystal or high-temperature compound crystal, quenching the composition to a temperature below the glass temperature at such a cooling rate, that the high-temperature solution crystal or high-temperature compound crystal is preserved as a metastable crystal phase in at least a part of the composition, annealing the composition under a vacuum or in an inert gas environment at an annealing temperature, which is below the glass temperature by a tolerance of at least a few degrees in order to vitrify the metastable crystal phase.

2. A method according to claim 1, wherein the composition is generated to a temperature below said annealing temperature and reheated to said annealing temperature.

3. A method according to claim 1, wherein the high-temperature solution crystal or high-temperature compound crystal has at temperatures below the glass temperature a lower free energy than the glass phase.

* * * * *